US008207852B2

(12) United States Patent
Oehlert et al.

(10) Patent No.: US 8,207,852 B2
(45) Date of Patent: Jun. 26, 2012

(54) AUDIBLE ALERT LOCK

(76) Inventors: Sherrie Oehlert, Kenosha, WI (US); Gene Oehlert, Kenosha, WI (US)

( * ) Notice: Subject to any disclaimer, the term of this patent is extended or adjusted under 35 U.S.C. 154(b) by 313 days.

(21) Appl. No.: 12/572,897

(22) Filed: Oct. 2, 2009

(65) Prior Publication Data

US 2011/0080287 A1 Apr. 7, 2011

(51) Int. Cl.
*G08B 13/14* (2006.01)

(52) U.S. Cl. ..... 340/571; 340/539.11; 340/568.2

(58) Field of Classification Search ..... 340/571, 340/432, 427, 426, 539.11, 541, 542, 572.9, 340/687, 568.2
See application file for complete search history.

(56) References Cited

U.S. PATENT DOCUMENTS

| | | | | |
|---|---|---|---|---|
| 3,939,679 | A * | 2/1976 | Barker et al. | 70/277 |
| 5,291,765 | A * | 3/1994 | Hoisington | 70/233 |
| 6,318,137 | B1 * | 11/2001 | Chaum | 70/278.3 |
| 6,690,267 | B2 * | 2/2004 | Linden et al. | 340/432 |
| 6,751,992 | B1 * | 6/2004 | Esquilin | 70/233 |
| 7,415,852 | B1 * | 8/2008 | Merrem | 70/58 |
| 2005/0212656 | A1 * | 9/2005 | Denison et al. | 340/5.73 |
| 2007/0296545 | A1 * | 12/2007 | Clare | 340/5.64 |
| 2011/0107802 | A1 * | 5/2011 | Basche | 70/312 |

* cited by examiner

*Primary Examiner* — Daniel Previl
(74) *Attorney, Agent, or Firm* — The Law Office of Jerry D. Haynes

(57) ABSTRACT

The present invention relates to an alert alarm lock system comprising: a lock; a cable assembly, where the lock may place the cable assembly in a locked position or an unlocked position; a copper conductor, where the copper conductor runs along the length of the cable assembly; a power source that provides power to the components of the lock system; a speaker that emits an audible alert; a wireless chip that transmits a RF signal to a remote receiver; a mechanism to initiate the alert and the transfer of the RF signal from the wireless chip.

7 Claims, 1 Drawing Sheet

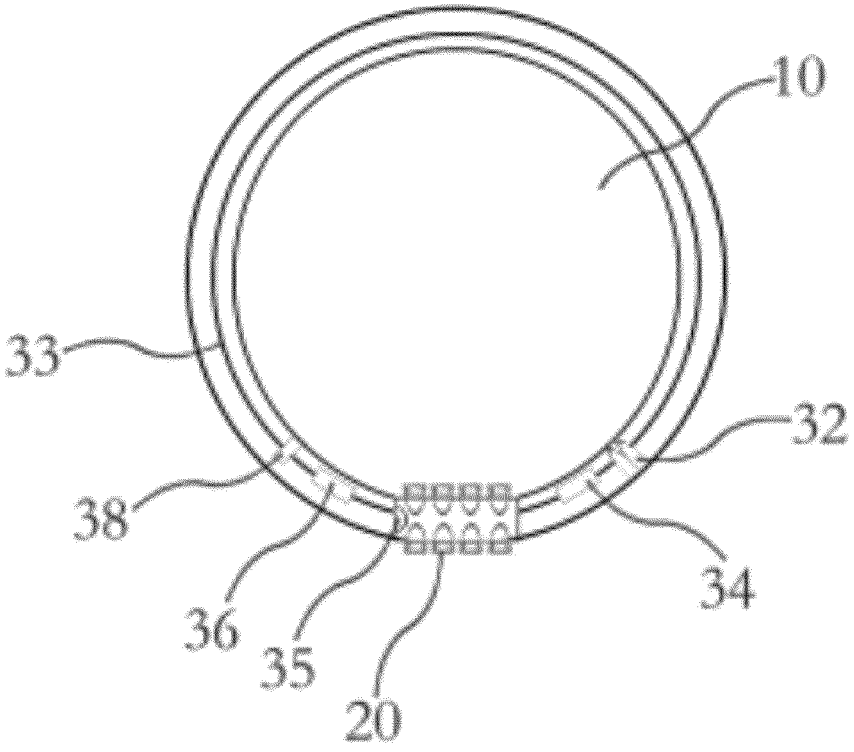
10
33
32
38
34
36
35
20

AUDIBLE ALERT LOCK

BACKGROUND OF THE INVENTION

1. Field of Invention

The present invention relates to an audible alert lock that provides an audible alert to a user that a theft may be in progress.

2. Description of Related Art

Physical security devices are utilized to prevent theft. One common physical security device is a bike lock or a locking cable that secures personal property to a fixed object in order to prevent the theft thereof. The locking devices may vary in size and security. Typical locking devices include combination locks, a pad key lock, cable locks, locking chains and locking skewers. These locking devices may be utilized to secure the personal property in order to prevent theft.

Further development has taken place in recent years with respect to the standard combination lock and cable that may be used to secure a bike or other personal property. Some locks have been developed that include audible alarms that enunciates an audible alarm if tampered or broken in order to further deter the theft of property. Many of the cable lock alarms of the prior art may include a flexible cable with a fixed end connected to a lock that sounds the audible alarm to alert the owner of an impending theft.

U.S. Pat. No. 4,811,578 discloses a padlock that comprises a battery powered built in alarm that operates when the padlock shaft is severed or forced open. Such a lock may be utilized with a chain or a cable to secure property and prevent theft. U.S. Pat. No. 5,191,314 discloses a combination lock and alarm having a flexible locking cable and alarm circuit to reduce the chance of theft and unauthorized displacement of personal property by causing an audible alarm signal to be sounded in the event the cable is severed or lock is vandalized.

Yet another example of an alarm locking system includes U.S. Pat. No. 5,786,759 which discloses an alarm and wire lock including an alarm circuit provided in the wire lock having a self retractable wire pre-wound in the lock casing and outwardly pulled to lock an object by fastening the wire onto the object. Upon the cutting of the wire, operation of the alarm circuit will be activated sounding a safety warning.

Further development of a more effective audible alarm lock is necessary to provide real time alert of a possible theft. It would be advantageous to have in addition to an audible sound, a wireless electronic alert which travels beyond the audible reach of the audible alarm on the lock.

SUMMARY OF THE INVENTION

The present invention relates to an alert alarm lock system comprising: a locking means; a cable assembly, where said locking means places the cable assembly in one of a locked position and an unlocked position; a copper conductor, where the copper conductor runs along the length of the cable assembly; a power source, where the power source provides power to the components of the lock system; a speaker, where said speaker emits an audible alert; a wireless chip, where said wireless chip transmits a RF signal to a remote receiver; a means to initiate the alert and the transfer of the RF signal from the wireless chip. In one particular embodiment, a relay may provide the means to initiate the alert and the transfer of the RF signal. The remote receiver emits an audible alarm upon receipt of the RF signal.

BRIEF DESCRIPTION OF DRAWINGS

FIG. 1 depicts the alert alarm locking cable according to a present invention.

DETAILED DESCRIPTION

The present invention relates to an alert lock alarm system that provides a state of the art cable-locking device. The alert alarm cable lock according to the present invention emits a audible alarm upon the severing or tampering with the lock or cable. In addition to providing an audible alarm, the present invention furthermore transmits a wireless signal to a receiver unit at a remote location that emits a second audio indication to inform the owner(s) that a theft may be occurring.

An alert alarm lock system 10 according to the present invention is depicted in FIG. 1. The alert lock alarm system according to present invention includes a tumbler style lock 20, which connects the cable and a copper conductor 33 within the cable assembly. The conductor 33 travels throughout the circumference of the lock when it's in a closed position and may run the length of the cable. Other components within the cable assembly include a power source 32, a speaker 34, a relay 35, a capacitor 36 and a wireless chip 38. In one particular embodiment, the power source 32 may include a 12-volt DC battery. The alert lock alarm 10 further includes a receiver, not shown, that may be stored at a remote location where the receiver receives a RF signal from the wireless chip 38 upon the separation of the conductor or tampering with the tumblers 20. The lock alarm 10 effectively provides an alert when the property being secured by the cable is outside the audible range of the audible alarm. The receiver may be placed at this remote location in order to receive the RF signal sent by wireless chip 38 upon the severing or tampering with the lock 10.

The speaker 34 emits the audible alarm that may be heard within the proximity of the lock and the property that is being secured by the lock. The electronic components such as the capacitor 36 provides a means to store energy over a period of time in order to ensure that adequate power reaches the speaker 34 in order to have the alarm emit its sound for a sufficient amount of time. The relay 35 provides a means to initiate the emission of the alarm and the transfer of the RF signal from the wireless chip 38 to the receiver. Once the receiver receives the RF signal, it too emits an audible alarm at the remote location in order to alert the owner of a possible theft.

The alert alarm system 10 provides the audible alarm both near the proximity of the locked item and at the remote location. This mode of operation enables the owner to alert the authorities without having to physically encounter the thief or robber, or the owner may also be able to take pictures or get a description of the thief without the thief's knowledge. The audible alarm will deter some thieves and for those who continue with the theft may be at least identified. The use of the alarm system 10 may be suitable for rental companies, mobile parks, campgrounds or other situations where owners may be at a remote location from their locked subject matter. The power source used on the alarm may be recharged through a plug-in charger not shown. The instant invention has been shown and described in what it considers to be the most practical and preferred embodiments. It is recognized, however, that departures may be made there from within the scope of the invention and that obvious modifications will occur to a person skilled in the art.

What is claimed is:

1. An alert alarm lock system comprising:

a. a locking means;

b. a cable assembly, where said locking means places the cable assembly in one of a locked position and an unlocked position;

c. a copper conductor, where the copper conductor runs along the length of the cable assembly;

d. a power source, where the power source provides power to components of the lock system;

e. a speaker, where said speaker emits an audible alert;

f. a wireless chip, where said wireless chip transmits a RF signal to a remote receiver;

g. a means to initiate the alert and transfer of the RF signal from the wireless chip.

2. The alert alarm lock system according to claim 1, further comprising a. a means to store energy over a period of time.

3. The alert alarm lock system according to claim 2, where said means to store energy includes a capacitor.

4. The alert alarm lock system according to claim 1, where said means to initiate the alert and the transfer of the RF signal include a relay.

5. The alert alarm lock system according to claim 1, where said remote receiver emits an audible alarm upon receipt of the RF signal.

6. The alert alarm lock system according to claim 1, where said power source is a 12-volt DC battery.

7. The alert alarm lock system according to claim 1, where the locking means includes a tumbler lock.

* * * * *